US007791880B2

(12) United States Patent
Chen et al.

(10) Patent No.: US 7,791,880 B2
(45) Date of Patent: Sep. 7, 2010

(54) FAN AND PLUG THEREOF

(75) Inventors: Tien-Min Chen, Taoyuan Hsien (TW); Te-Tsai Chuang, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 274 days.

(21) Appl. No.: 12/068,521

(22) Filed: Feb. 7, 2008

(65) Prior Publication Data

US 2008/0261432 A1 Oct. 23, 2008

(30) Foreign Application Priority Data

Apr. 17, 2007 (TW) ..... 96113438 A

(51) Int. Cl.
*H05K 7/20* (2006.01)

(52) U.S. Cl. ..... 361/695; 439/131

(58) Field of Classification Search ..... 361/695; 439/131, 172

See application file for complete search history.

(56) References Cited

U.S. PATENT DOCUMENTS 6,190,197 B1 * 2/2001 Polgar et al. ..... 439/527
7,287,994 B1 * 10/2007 Liao ..... 439/172

* cited by examiner

*Primary Examiner*—Ross N Gushi
(74) *Attorney, Agent, or Firm*—Birch, Stewart, Kolasch & Birch, LLP

(57) ABSTRACT

A fan is disclosed. The fan includes a fan frame and a plug. The fan frame includes a circumference portion, an accommodating portion located in the circumference portion and having two sidewalls, and at least two fixed holes respectively disposed on two sidewalls of the accommodating portion. The plug disposed in the accommodating portion of the fan frame includes a base, a bipolar knife-shaped terminal and a cover. The base includes two sides and two connecting portions respectively disposed on the sides to connect the fan frame. The bipolar knife-shaped terminal is disposed on the base and located between the connecting portions of the base. The cover is engaged to the base.

18 Claims, 4 Drawing Sheets

FAN AND PLUG THEREOF

CROSS REFERENCE TO RELATED APPLICATIONS

This Non-provisional application claims priority under U.S.C. §119(a) on Patent Application No(s). 0961134, filed in Taiwan, Republic of China on Apr. 17, 2007, the entire contents of which are hereby incorporated by reference.

BACKGROUND OF THE INVENTION

1. Field of the Invention

The present invention relates to a fan and a plug thereof, and more particularly to a fan with a plug for quickly connecting to an external system and avoiding wire interference.

2. Description of the Related Art

With high development of the performances and the high operational speed, of electronic or mechanical systems, heat generated by the systems relatively increases. A fan is used to dissipate heat from systems and keep the operational temperature within normal ranges.

FIG. 1, a conventional fan 1 is provided with a set of wires 11 and a terminal 12 connected or welded to the wires 11 to couple to an object such as a motherboard, a circuit board or a mechanical device (not shown) for receiving power and driving signals.

The wires 11 welded to the terminal 12 is configured with a predetermined or long length. When the wires 11 are coupled in an external system (not shown), the excess length of the wires 11 in the system causes interference with other components or parts. Thus, reliability of the fan 1 decreases.

BRIEF SUMMARY OF THE INVENTION

The present invention provides a fan and a plug thereof to be electrically connected to an external system. An embodiment of a plug, providing a quick connection function and connected to a fan frame, includes a base, a bipolar knife-shaped terminal and a cover. The base includes two sides and two connecting portions respectively disposed on the sides and connected to the fan frame. The bipolar knife-shaped terminal is disposed on the base and located between the two connecting portions of the base. The cover is engaged to the base.

Additionally, an embodiment of a fan includes a fan frame and a plug. The fan frame includes a circumference portion, an accommodating portion located in the circumference portion and having two sidewalls, and at least two fixed holes respectively disposed on two sidewalls of the accommodating portion. The plug disposed in the accommodating portion of the fan frame includes a base, a bipolar knife-shaped terminal and a cover. The base includes two sides and two connecting portions respectively disposed on the sides to connect the fan frame. The bipolar knife-shaped terminal is disposed on the base and located between the two connecting portions of the base. The cover is engaged to the base.

Based on the description above, it is understood that the plug provides the connecting portions at the base for quickly connecting to the fan frame, and the interference caused by excess wires of the conventional fan is avoided. With respect to the conventional fan, the fan of this embodiment is electrically coupled to the external system precisely, thus, the reliability of electrical connection is enhanced.

A detailed description is given in the following embodiments with reference to the accompanying drawings.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

The following description is of the best-contemplated mode of carrying out the present invention. This description is made for the purpose of illustrating the general principles of the present invention and should not be taken in a limiting sense. The scope of the present invention is best determined by reference to the appended claims.

Figure 1:
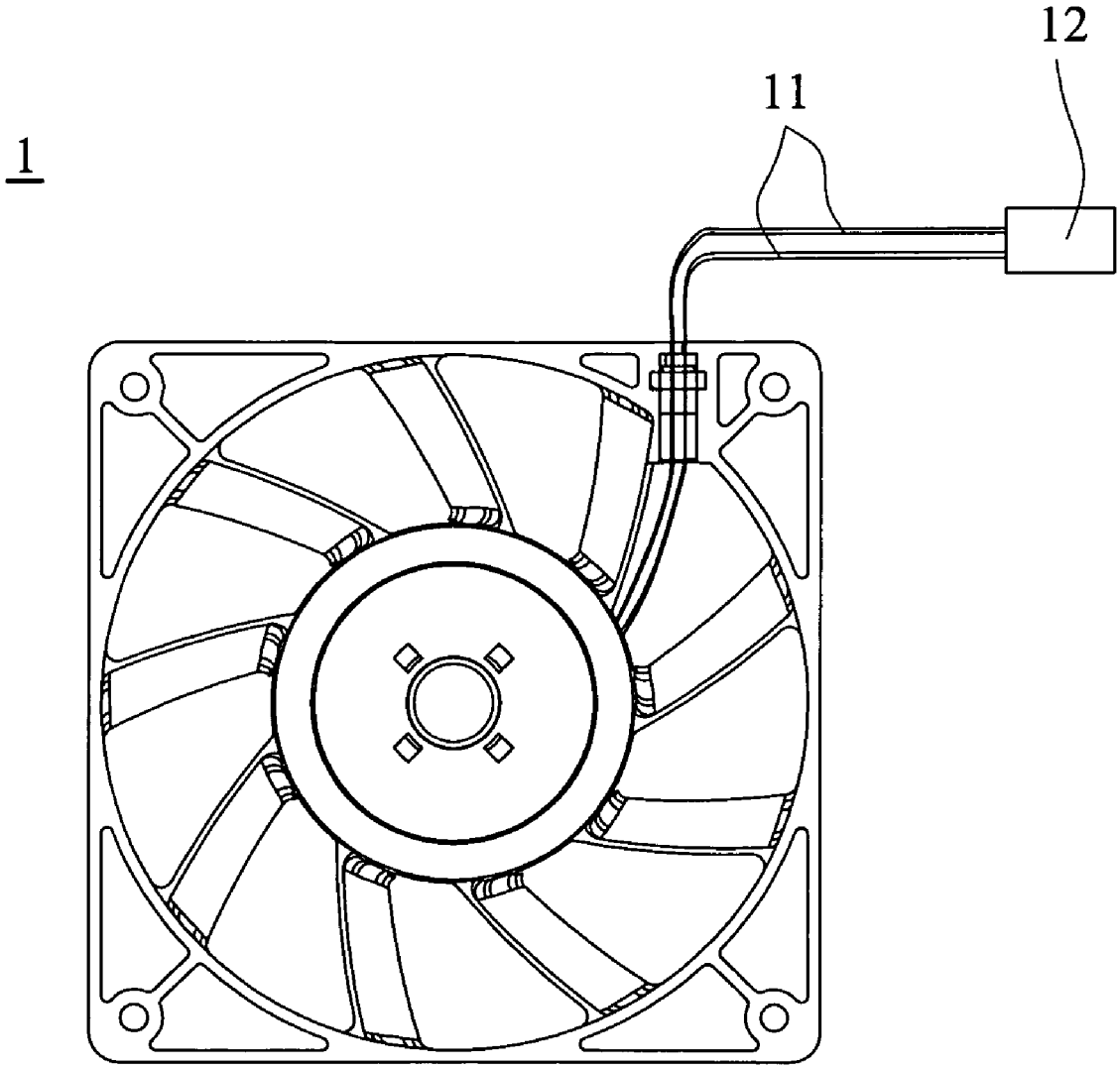
FIG. 1 (PRIOR ART)
FIG. 1 is a schematic illustration of a conventional fan.
Figure 2A:
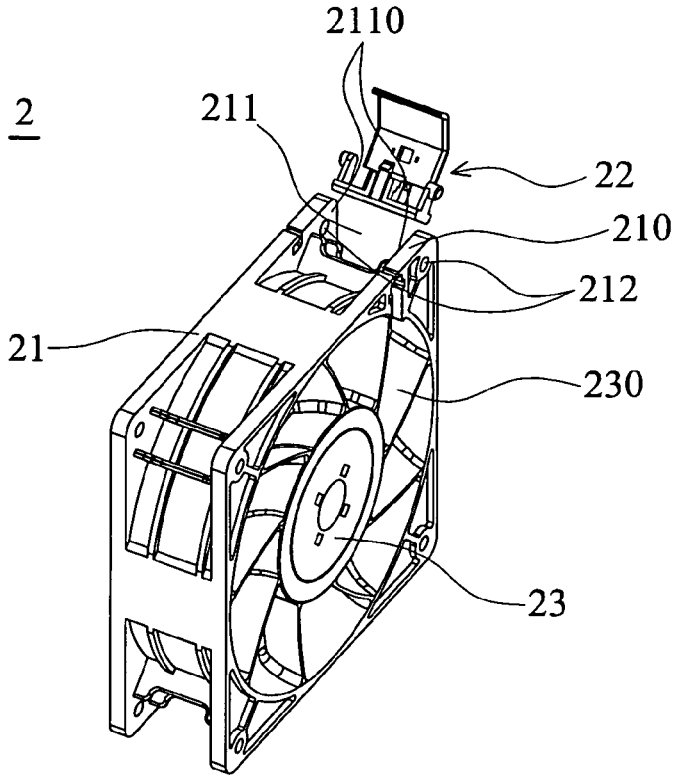
FIG. 2A is a perspective view of a fan and a plug of the embodiment of the present invention before assembly.
Figure 2B:
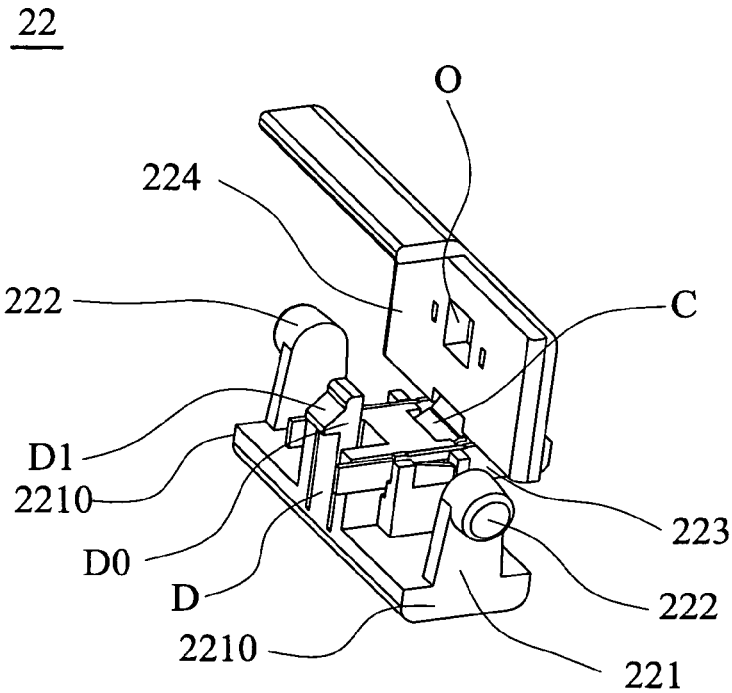
FIG. 2B is an enlarged view of the plug of FIG. 2A.
Figure 3A:
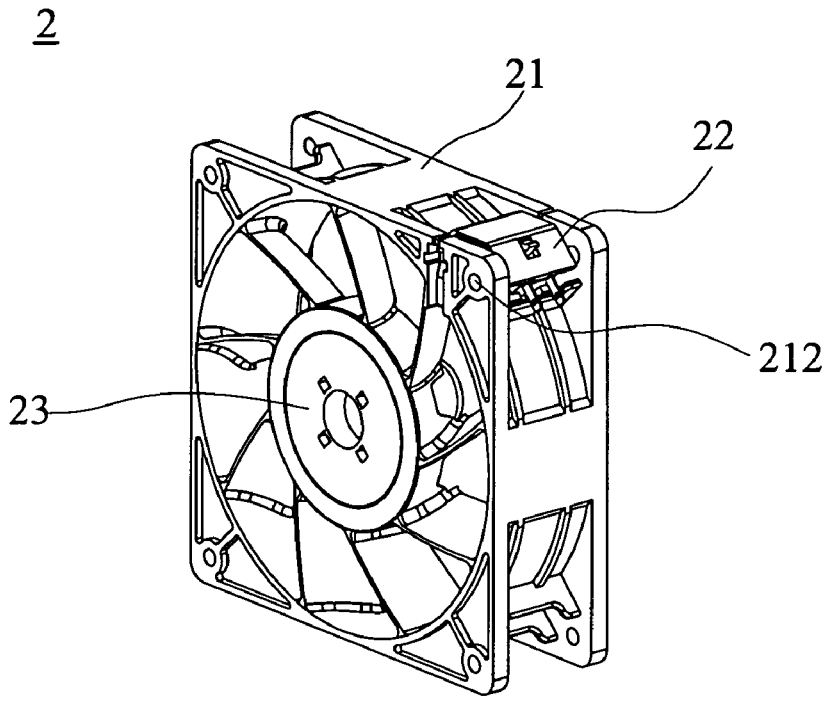
FIG. 3A is a perspective view of a fan and a plug of the embodiment of the present invention after assembly.
Figure 3B:
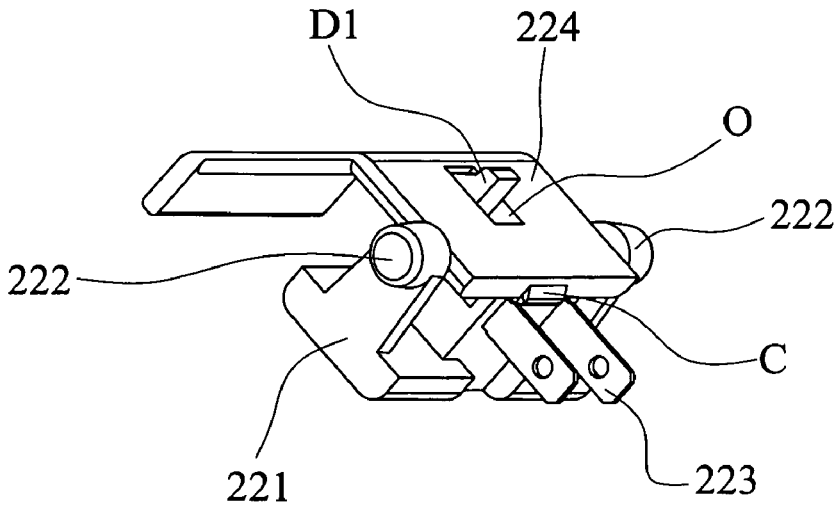
FIG. 3B is an enlarged view of the plug of FIG. 3A.
Figure 4A:
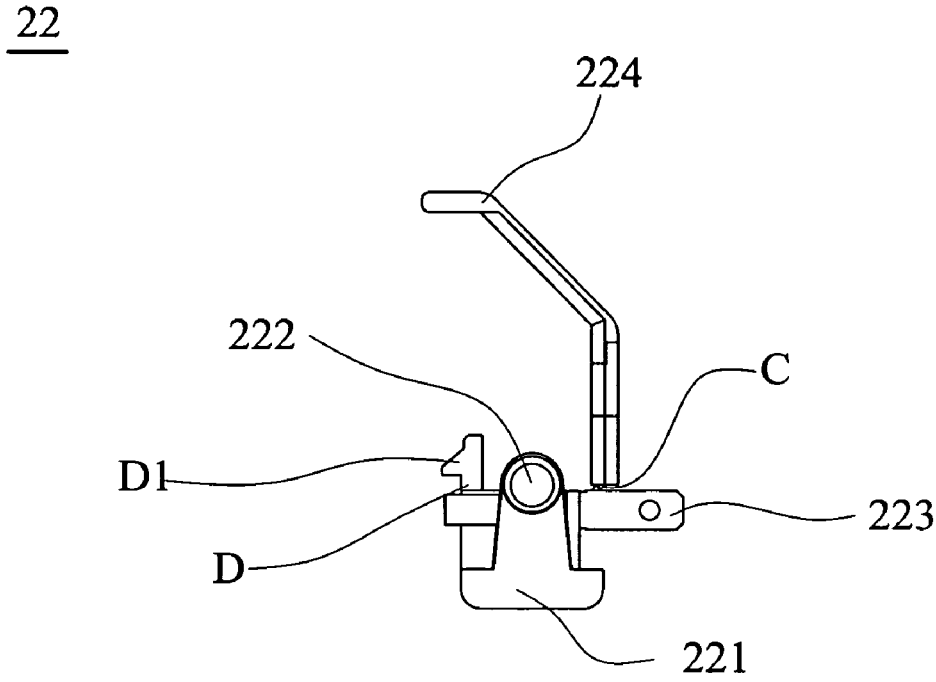
FIG. 4A is a side view of the plug of FIG. 2B.
Figure 4B:
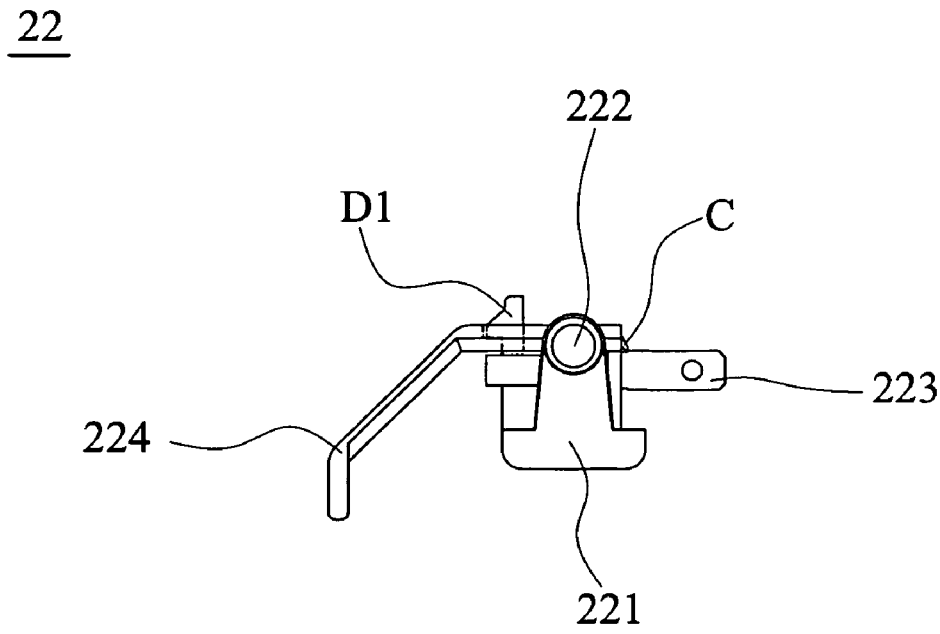
FIG. 4B is a side view of the plug of FIG. 3B.

In FIGS. 2A and 2B, a fan 2, such as an axial-type fan, includes a fan frame 21 and a plug 22. The fan frame 21 includes a circumference portion 210, an accommodating portion 211 located in the circumference portion 210 and having two sidewalls 2110, and two fixed holes 212 respectively disposed on two sidewalls 2110 of the accommodating portion 211. In this embodiment, the fixed holes 212 are disposed on two corresponding sidewalls 2110 of the accommodating portion 211, but the present invention is not limited to this embodiment.

The plug 22 disposed in the accommodating portion 211 of the fan frame 21 includes a base 221, a bipolar knife-shaped terminal 223 made of a conductive material, and a cover 224 engaged to the base 221. The base 221 includes two sides 2210 and at least two connecting portions 222 respectively disposed on the sides 2210 and corresponding to the fixed holes 212. The connecting portions 222 are connected to the fixed holes 212 of the fan frame 21, thus, allowing the plug 22 to be received to the accommodating portion 211 of the fan frame 21. The bipolar knife-shaped terminal 223 is disposed on the base 221 and located between the connecting portions 222 of the base 221. The cover 224 engaged to the base 221 is utilized to clamp the bipolar knife-shaped terminal 223.

The size of diameter of the fixed holes 212 of the fan frame 21 is greater than that of the connecting portions 222, so as to smoothly engage the connecting portions 222 of the base 221 to the fixed holes 212 of the fan frame 21. The depths of the fixed holes 212 of the fan frame 21 are greater than or equal to the lengths of the connecting portions 222, thus, preventing the installed connecting portions 222 from projecting from the fan frame 21 and interfering with the external system during the assembling process (not shown). The fixed holes 212 of the fan frame 21 are formed as elliptical, circular or polygonal shapes, and the connecting portions 222 of the base 221 is formed as elliptical, circular or polygonal posts, but the present invention is not limited to these shapes. The connecting portions 222 and the base 221 can be integrally formed as a single. The base 221 of the plug 22 and the cover 224 can also be integrally formed as a single unit. Additionally, the width of the base 221 is approximately less than that of the accommodating portion 211, thus, to smoothly engage the plug 22 to the accommodating portion 211.

The fan 2 further includes a motor 23. The motor 23 is electrically connected to the bipolar knife-shaped terminal 223 of the plug 22 to drive the fan 2. The bipolar knife-shaped terminal 223 can be made of a conductive material. The fan 2 further includes a bent portion "C" disposed between the cover 224 and the base 221, and the bent portion "C" connects the cover 224 to the base 221. The cover 224 includes a through hole "O". The base 221 includes a hook rod "D" having an end D0 and a hook portion D1 located at the end D0. As shown in FIGS. 3A, 3B, 4A and 4B, when the bipolar knife-shaped terminal 223 is disposed on the base 221, the hook portion D1 of the hook rod "D" is hooked in the through hole "O" via the bent portion "C", clamping the bipolar knife-shaped terminal 223 between the cover 224 and the base 221 forming the plug 22.

Based on the description above, it is understood that the plug 22 provides the connecting portions 222 and the base 221 for quickly connecting the fan frame 21, and the interference caused by excess wires 11 of the conventional fan 1 is avoided. With respect to the conventional fan 1, the fan 2 of this embodiment is electrically coupled to the external system precisely, thus, reliability of electrical connection is enhanced.

While the present invention has been described by way of example and in terms of the preferred embodiments, it is to be understood that the present invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A plug connected to a fan frame, the plug comprising:

a base, comprising two sides and two connecting portions respectively disposed on the sides and connected to the fan frame, and having a hook rod with an end and a hook portion located at the end;

a bipolar knife-shaped terminal disposed on the base and located between said two connecting portions of the base; and a cover engaged to the base, comprising a through hole for the hook portion to be hooked therein.

2. The plug as claimed in claim 1, wherein each of the connecting portions of the base is formed as an elliptical, circular, square or polygonal post shape.

3. The plug as claimed in claim 1, wherein the connecting portions and the base are integrally formed as a single unit.

4. The plug as claimed in claim 1, wherein the cover and the base are integrally formed as a single unit.

5. The plug as claimed in claim 4, further comprising a bent portion for connecting the cover to the base.

6. The plug as claimed in claim 1, wherein the hook portion is hooked in the through hole, thereby clamping the bipolar knife-shaped terminal between the cover and the base.

7. The plug as claimed in claim 1, wherein the bipolar knife-shaped terminal is made of a conductive material.

8. A fan, comprising:

a fan frame, comprising a circumference portion, an accommodating portion located in the circumference portion and having two sidewalls, and at least two fixed holes respectively disposed on two sidewalls of the accommodating portion; and a plug disposed in the accommodating portion of the fan frame, comprising:

a base, comprising two sides and two connecting portions respectively disposed on the sides to connect the fan frame, and having a hook rod with and end and a hook portion located at the end;

a bipolar knife-shaped terminal disposed on the base and located between the two connecting portions of the base; and a cover engaged to the base and comprising a through hole for the hook portion to be hooked therein.

9. The fan as claimed in claim 8, wherein a size of diameter of the fixed holes of the fan frame is greater than that of the connecting portions, and each of the fixed holes of the fan frame corresponds to each connecting portion.

10. The fan as claimed in claim 8, wherein a depth of each fixed hole of the fan frame is greater than or equals to a length of each connecting portion.

11. The fan as claimed in claim 8, wherein each of the fixed holes of the fan frame has an elliptical, circular or polygonal shape.

12. The fan as claimed in claim 8, wherein each of the connecting portions of the base is formed as an elliptical, circular or polygonal post shape.

13. The fan as claimed in claim 8, wherein the connecting portions and the base are integrally formed as a single unit.

14. The fan as claimed in claim 8, wherein the base of the plug and the cover are integrally formed as a single unit.

15. The fan as claimed in claim 14, wherein the plug further comprises a bent portion for connecting the cover to the base.

16. The fan as claimed in claim 8, wherein the hook portion of the hook rod is hooked in the through hole, thereby clamping the bipolar knife-shaped terminal between the cover and the base.

17. The fan as claimed in claim 8, wherein the bipolar knife-shaped terminal is made of a conductive material.

18. The fan as claimed in claim 8 further comprising a motor electrically connected to the plug.

* * * * *